US009352387B2

(12) United States Patent
Mancini

(10) Patent No.: US 9,352,387 B2
(45) Date of Patent: May 31, 2016

(54) METHOD AND PLANT FOR MANUFACTURING LIGHT ALLOY CASTINGS BY INJECTION DIE CASTING WITH NON-METALLIC CORES

(71) Applicant: Flavio Mancini, Brescia (IT)

(72) Inventor: Flavio Mancini, Brescia (IT)

( * ) Notice: Subject to any disclaimer, the term of this patent is extended or adjusted under 35 U.S.C. 154(b) by 0 days.

(21) Appl. No.: 14/403,524

(22) PCT Filed: May 28, 2013

(86) PCT No.: PCT/IB2013/054409

§ 371 (c)(1),
(2) Date: Nov. 24, 2014

(87) PCT Pub. No.: WO2013/179225

PCT Pub. Date: Dec. 5, 2013

(65) Prior Publication Data

US 2015/0090420 A1 Apr. 2, 2015

(30) Foreign Application Priority Data

Jun. 1, 2012 (IT) ..... MI2012A0950

(51) Int. Cl.

| | |
|---|---|
| ***B22D 17/02*** | (2006.01) |
| ***B22D 17/04*** | (2006.01) |
| ***B22D 17/20*** | (2006.01) |

(Continued)

(52) U.S. Cl.

CPC ..... *B22D 17/02* (2013.01); *B22D 17/04* (2013.01); *B22D 17/14* (2013.01); *B22D 17/20* (2013.01); *B22D 17/2038* (2013.01); *B22D 17/22* (2013.01); *B22D 21/007* (2013.01)

(58) Field of Classification Search

CPC ..... B22D 17/02; B22D 17/04; B22D 17/2038
USPC ..... 164/62, 113, 120, 133, 312, 316–318
See application file for complete search history.

(56) References Cited

U.S. PATENT DOCUMENTS

| | | | | |
|---|---|---|---|---|
| 3,874,440 | A | 4/1975 | Voisin | |
| 4,085,791 | A * | 4/1978 | Kaiser | B22D 17/14 164/113 |

(Continued)

FOREIGN PATENT DOCUMENTS

| | | |
|---|---|---|
| IT | 1376503 | 10/2006 |
| JP | S6234661 | 2/1987 |

OTHER PUBLICATIONS

International Search Report issued in PCT Application No. PCT/IB2013/054409.

*Primary Examiner* — Kevin E Yoon
(74) *Attorney, Agent, or Firm* — Lucas & Mercanti, LLP.

(57) ABSTRACT

A method for manufacturing light alloy castings by die casting with disposable cores, including a mold filling phase in which the parameters of pressure and speed of the molten alloy are controlled at levels tolerable by the cores until the cavities around the latter are filled by the molten alloy, and thereafter the pressure and speed parameters are controlled at levels suitable for completing and compacting the casting, the alloy being kept at a temperature close to its melting temperature throughout the whole path between the pump that pressurizes it and the entrance to the cavities around the cores. The invention relates also to a plant implementing said method by means of a pump connected to a mold through a duct that comes out within the casting envelope at a point close to the centroid of the cores.

5 Claims, 7 Drawing Sheets

Figure 1:
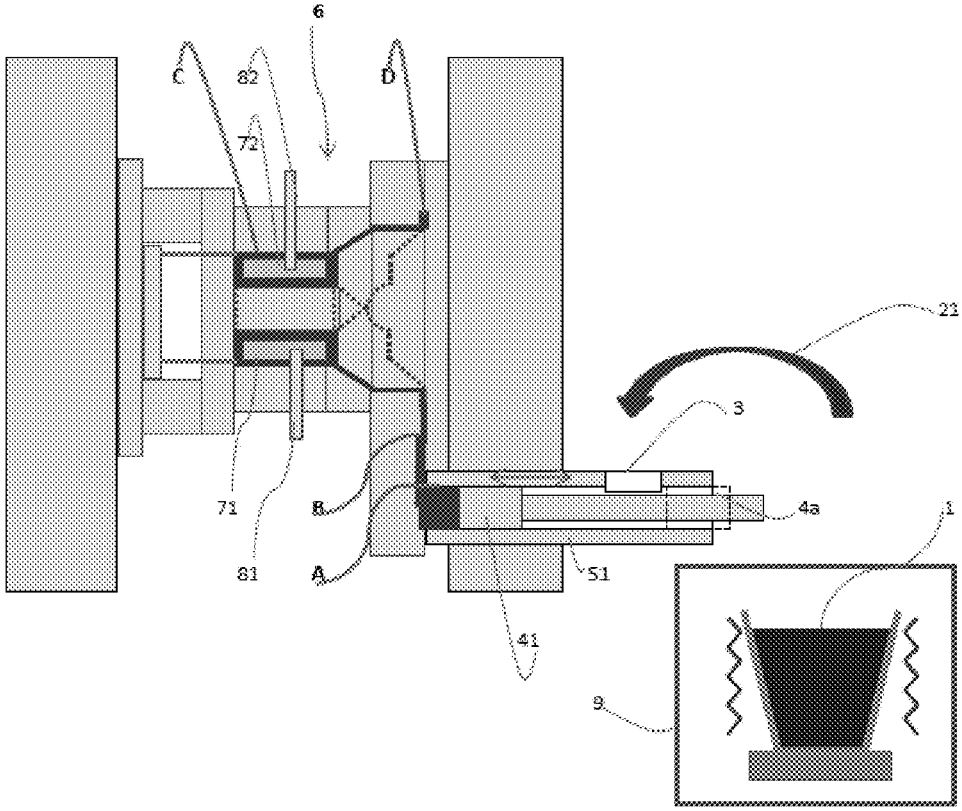
PRIOR ART FIG. 1

(51) Int. Cl.

| | |
|---|---|
| ***B22D 17/14*** | (2006.01) |
| ***B22D 17/22*** | (2006.01) |
| ***B22D 21/00*** | (2006.01) |

(56) References Cited

U.S. PATENT DOCUMENTS

| | | | | |
|---|---|---|---|---|
| 4,088,178 | A | 5/1978 | Ueno et al. | |
| 4,686,943 | A | 8/1987 | Anno et al. | |
| 5,372,181 | A * | 12/1994 | Watanabe | B22D 18/04 164/113 |
| 5,960,854 | A * | 10/1999 | Fink | B22D 17/2038 164/316 |
| 6,564,856 | B1 * | 5/2003 | Buckley | B22C 1/00 164/120 |
| 6,793,000 | B2 * | 9/2004 | Fink | B22D 17/32 164/113 |
| 2006/0185815 | A1 | 8/2006 | Yaokawa et al. | |
| 2009/0205801 | A1 | 8/2009 | Yaokawa et al. | |
| 2009/0288797 | A1 | 11/2009 | Yaokawa et al. | |
| 2011/0062624 | A1 | 3/2011 | Yamada | |

* cited by examiner

METHOD AND PLANT FOR MANUFACTURING LIGHT ALLOY CASTINGS BY INJECTION DIE CASTING WITH NON-METALLIC CORES

CROSS-REFERENCE TO RELATED APPLICATIONS

This application is a 371 of PCT/IB2013/054409, filed May 28, 2013, which claims the benefit of Italian Patent Application No. MI2012A000950, filed Jun. 1, 2012, the contents of each of which are incorporated herein by reference.

FIELD OF THE INVENTION

The present invention relates to a method for obtaining castings in light alloys, particularly aluminum alloys but not only, with disposable cores of non-metallic nature, through low-medium pressure die casting plants, and in particular for obtaining castings for the cylinder blocks of internal combustion engines with high specific torque of the type with closed ceiling (so-called "closed deck").

BACKGROUND OF THE INVENTION

Any casting which encloses an internal cavity having a transverse dimension greater than the homologous dimension of its opening connecting it with the space outside the casting or in any case in the presence of significant undercuts, which cannot be eliminated prior to the extraction of permanent cores through translations and/or rotations, requires cores or parts thereof that can be destroyed and eliminated after the extraction of the solidified casting from the mold.

For this reason the permanent metallic cores, which generate the cavities for the flow of the coolant of the cylinder blocks of internal combustion engines made by die casting, are extracted through the ceiling of the block and leave large openings which weaken the structure and impose limits on the ignition pressure, thus preventing to increase the torque and efficiency of current engines.

The structures of closed deck cylinder blocks, with particular regard to the cooling cavities of the cylinders, are known and implemented since a long time, as for example described in U.S. Pat. No. 4,686,943. These cylinder blocks are currently obtained from cast iron or aluminum alloy castings, cast by gravity in non-durable or durable molds, with disposable cores generally made of sand.

Numerous methods and materials are known in the art for the construction of these cores, with physical and chemical characteristics very different from each other and different ease of destruction and extraction from the cavity. The process and technology of production of said cores differ greatly from each other and can create significant advantages or disadvantages on the outcome of the casting and on their extraction from it.

The main features of the cores affecting the die casting process are the mechanical characteristics of bending, tensile, compression and erosion resistance; these vary greatly with the manufacturing processes and are often conflicting among them, as for example the mechanical resistance and the ease of destruction and removal.

The process of high pressure die casting (HPDC), currently the most economic for the production of cylinder blocks with open ceiling (so-called "open deck"), uses final pressures on the alloy of many hundreds of bar. In this process, during the filling of the mold, the alloy has a kinetic energy that can generate significant pressures on the walls invested directly by the flow and which can generate very high bending stresses on the cores. Furthermore, significant differences in pressure may occur on the opposite walls of the core immersed in the flow of alloy, with the generation of very high bending stress on the core. Then there are non-negligible local tensile stresses caused by the thermal asymmetry due to the poor thermal conductivity of all non-metallic cores.

The combination of these factors, placing the core under local pressure and bending stresses that are not bearable by the materials that have little resistance to local compression and low tensile strength, easily cause erosion and breakage of the cores and rejection of the castings. This has so far prevented the realization of "closed deck" cylinder blocks with the HPDC process and has prevented the realization of high-efficiency engines.

Cores of ceramic nature, which could withstand the stresses of the process being able to reach higher values of bending strength and erosion resistance, present great difficulties of destruction and extraction from the cavities of the casting, which become greater the higher the mechanical characteristics become, being impossible to make use of easy thermal or dissolution break-up processes. A complex geometric conformation of the cavities, required by structural or functional reasons, could make very difficult and uncertain the complete extraction of the fragments and thus the use of such materials.

The cores obtained from sand and organic or inorganic binders offer good ease of extraction, by mechanical or thermal or combined processes, and have acceptable construction costs and recycling or disposal costs, but have modest mechanical properties which are insufficient to use them with the HPDC process since they offer a strength of a few MPa in bending and a dozen MPa in compression.

Currently under consideration are also die casting processes with cores in mixtures of die cast salts, soluble in water, possibly additioned with inert components, as described in US 2006/01858015, US 2009/0205801, US 2009/0288797, US 2011/0062624 and others. These cores have mechanical properties even far superior to those of the best sand cores, but ecological problems could hinder their application.

In horizontal cold chamber HPDC presses, for functional reasons, the mold must be fed by a casting system, meant as a set of supply ducts of the molten alloy, all outside the envelope of the mold itself, with feeding points of the mold usually far from the area of any disposable cores, as will be explained in the description of the system. This causes a considerable thermal loss of the alloy and implies the need of short filling times of the mold via high speed flows and, consequently, a high injection pressure.

The order of magnitude of the compaction pressure of the casting is several hundreds of bars, reason why every little cavity or crevice of the non-metallic core is filled by the alloy, its penetration being favored by the very low thermal conductivity of the core. This results in a high probability of damage of the cores invested by the flow and, above all, defects in the castings.

However, the considerations above are still the subject of authoritative studies by the major manufacturers of the automotive industry, which has achieved a specific power of light alloy engines no longer improvable with HPDC technology that currently requires all manufacturers to use removable metal cores of sizes equal to those of the cooling cavities, i.e. to adopt cylinder blocks with "open deck" structure with weakened ceiling.

This would be directing the mass production of "closed deck" cylinder blocks towards a process with low-pressure alloy feed to the mold (LPDC=Low Pressure Die Casting), possibly assisted by creating a vacuum in the mold.

This technology, which covers a much smaller fraction than the HPDC process on the total of castings for the automotive sector, is widespread for the production of castings such as medium series of light alloy wheels, as well as for the production of cylinder-heads of the motors that mandatorily require sand cores because of the intricate shapes of the ducts.

In this type of plants the alloy is pushed into the mold of heat resistant steel, placed above the oven, through a large vertical tube having the lower end immersed in the molten alloy, using a slightly compressed gas, usually air, which is then discharged in the atmosphere after the solidification of the casting. In these plants, the overpressure of the feed gas is usually comprised between 0.5 and 1.5 bar for essentially structural reasons, and in any case it could not be of higher orders of magnitude due to the nature and the consumption of the propellant. The process uses therefore pressures of about one order higher than that of the casting by gravity, with times of filling of the impression indicatively of one or two tens of seconds.

Even using the combined technology, with vacuum aspiration and subsequent gas pressure, it would not be easy to achieve the feeding of the solidification shrinkage, especially on parts of the casting far away from the gate. This obliges to have any pouring spout of significant cross-section and of limited length, and, especially, to have casting thicknesses usually higher than necessary. Furthermore the high temperatures of both the molten alloy and the mold involve a low cooling rate, of the order of a few minutes, due also to the considerable molten mass contained in the feed duct.

Additional limitations to the LPDC process result from the strong non-uniformity of the thicknesses that may be required to the casting, since the thin parts distant from the point of supply would cause shrinkage porosity in nearby thicker parts that cool down more slowly, and these may be not fed by the negligible pressure existing at the upper end of the supply duct, due to the viscosity of the alloy which increases while the passages are reduced with the progress of solidification. This often results in unnecessary or detrimental weighting of the castings and, in any case, in low rates of production.

SUMMARY OF THE INVENTION

The applicant has devised a die casting process at variable low to medium pressure and speed (so-called LMPDC=Low-Medium Pressure Die Casting) that allows to optimize the structure, conformation, quality and manufacturing costs of aluminum alloys castings with non-metallic structure of the cores of any kind, including sand, adapting the flow parameters to the needs of the cores.

This LMPDC process is based on the concept of injecting the molten alloy inside the envelope of the casting, in the technically accessible point closest to the centroid of the cores thus minimizing the feed paths, at the maximum speed and pressure tolerable by the mechanical characteristics of the cores. The alloy is injected at practically the same temperature at which it is maintained in the crucible and the instant in which it has filled the cavities around the cores, regardless of the filling of other parts of the casting, the pressure and speed of the molten alloy are increased to values sufficient to complete such other parts and to subsequently compact the whole casting.

This cycle is made possible by the fact that, from said instant on, the cores are practically in the state of pure hydrostatic compression, with no or negligible flow velocity on their surfaces, and therefore are not subject to local compressive, bending and/or tensile and/or shear stresses nor to risks of erosion.

Bearing in mind that the static liquid-solid contact generates on the latter local stress values lower than the solid-solid contact and that fragile cores are used, with widespread and very variable local defects and with the need of a small probability of damage, the hydrostatic pressure of the alloy on the undamaged core can go even beyond the experimental values of the resistance to solid-solid compression of the cores, without them suffering significant damage. Such an increase in pressure, being permissible even before the completion of other hydrodynamically distant parts of the casting, facilitates the completion thereof even in the presence of thin thicknesses.

The cycle is made practicable by the possibility to adjust the temperature of the alloy during its whole path between the source of its pressure and the envelope of the core(s), as well as by the compatible switching times of the parameters, resulting from the low supplying speed of the alloy to the cavities of the cores, related to the monitoring of the temperatures of the alloy.

In this way the solidification shrinkage can be fed, avoiding rejects caused by inclusions of erosion products and drastically reducing the possibility of gas bubbles, being the volume of the casting system very small and modest the initial speeds, achieving in many cases the possibility of welding and/or thermal treatments, qualities hardly obtainable with the HPDC process.

Normally also in the HPDC cycle there are major increases in alloy pressure, but only after the total filling of the mold when the flow velocities drop to zero in all parts of the casting including the most distant from the disposable cores. This is due to the increase of the resistance to flow as the alloy fills the mold cavities, with instantaneous increase of the hydrostatic pressure when the casting is complete given the incompressibility of the alloy. But the dynamic stresses are those really dangerous for the cores, those stresses which are avoided in the LMPDC process whereas they are not avoidable in the HPDC process.

DETAILED DESCRIPTION OF THE INVENTION

Figure 2:
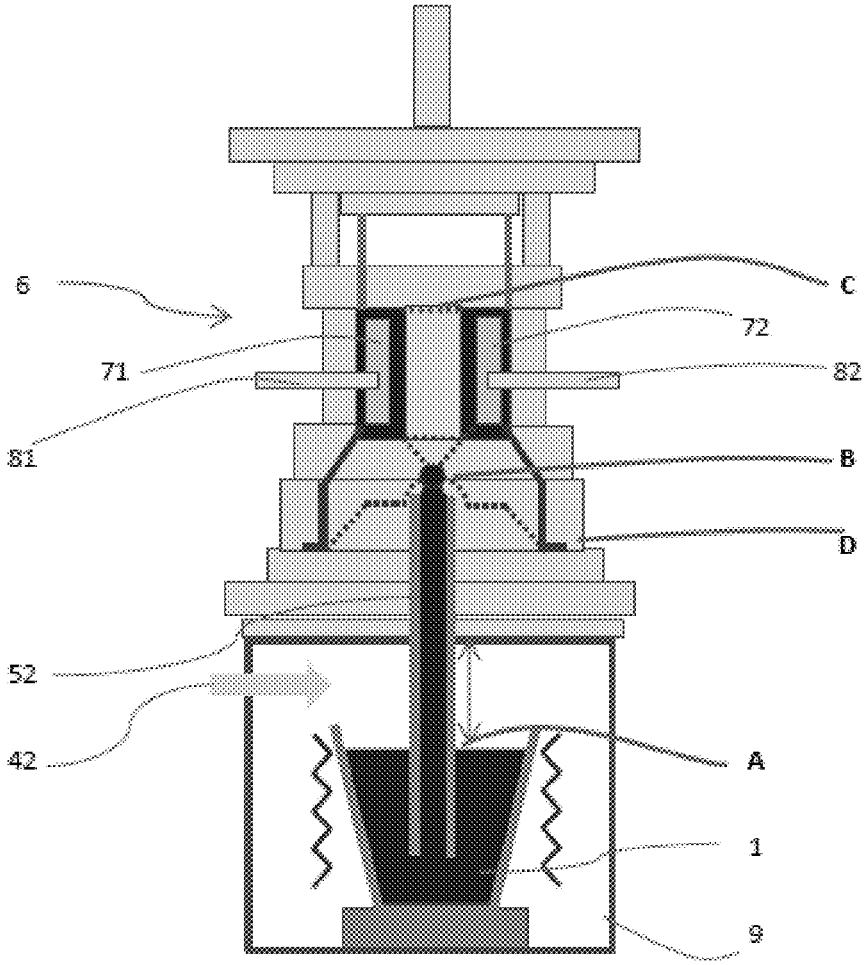
PRIOR ART FIG. 2

Bearing in mind the above, a scheme of the current state of the art is shown schematically in FIGS. 1 and 2: FIG. 1 represents the injection portion of a HPDC plant and FIG. 2 that of a LPDC plant.

In the scheme of HPDC horizontal high pressure cold chamber of FIG. 1, the molten alloy 1, superheated well above the melting temperature, is transferred with a device 21 from oven 9 into container 51, through mouth 3, when the piston injector 41 is in the retracted position 4*a* (shown in dashed line). Subsequently, the molten alloy is driven at low speed by piston 41 (shown in position at the end of filling) up to the casting gate B and then at high speed in the closed metal mold 6, which contains the disposable non-metallic cores 71 and 72 supported by supports 81 and 82, retractable or non-retractable, so as to create for the alloy spaces between said non-metallic cores 71, 72 and the metal mold 6. In this phase cores 71, 72 are invested by the flow of alloy at high speed, up to the total filling of mold 6, and an instant after the casting is compacted under very high pressure.

Upon solidification and removal of the casting from the open mold, said cores 71 and 72, if they have withstood the stresses and consequently the casting is intact, must be destroyed and extracted to obtain the requested cavities in the casting. Note that in order to avoid the beginning of the filling of mold 6 during the operation of pouring the molten alloy 1 with device 21, container 51 must necessarily be situated in a position lower than the mold itself and this confines the casting device in the space outside the casting envelope.

In the LPDC low-pressure die casting scheme of FIG. 2 the molten alloy 1, strongly overheated, is pushed at the speed determined by the low pressure of gas 42 in the pressurized oven 9, through the feed pipe 52, into the closed metal mold 6, represented at the end of filling, which contains the disposable non-metallic cores 71, 72 supported as described above. Upon solidification and removal of the casting from the open mold, the cores 71 and 72, which have not been subjected to high stresses given the low flow velocities in the relevant cavities, are destroyed and extracted.

Figure 3:
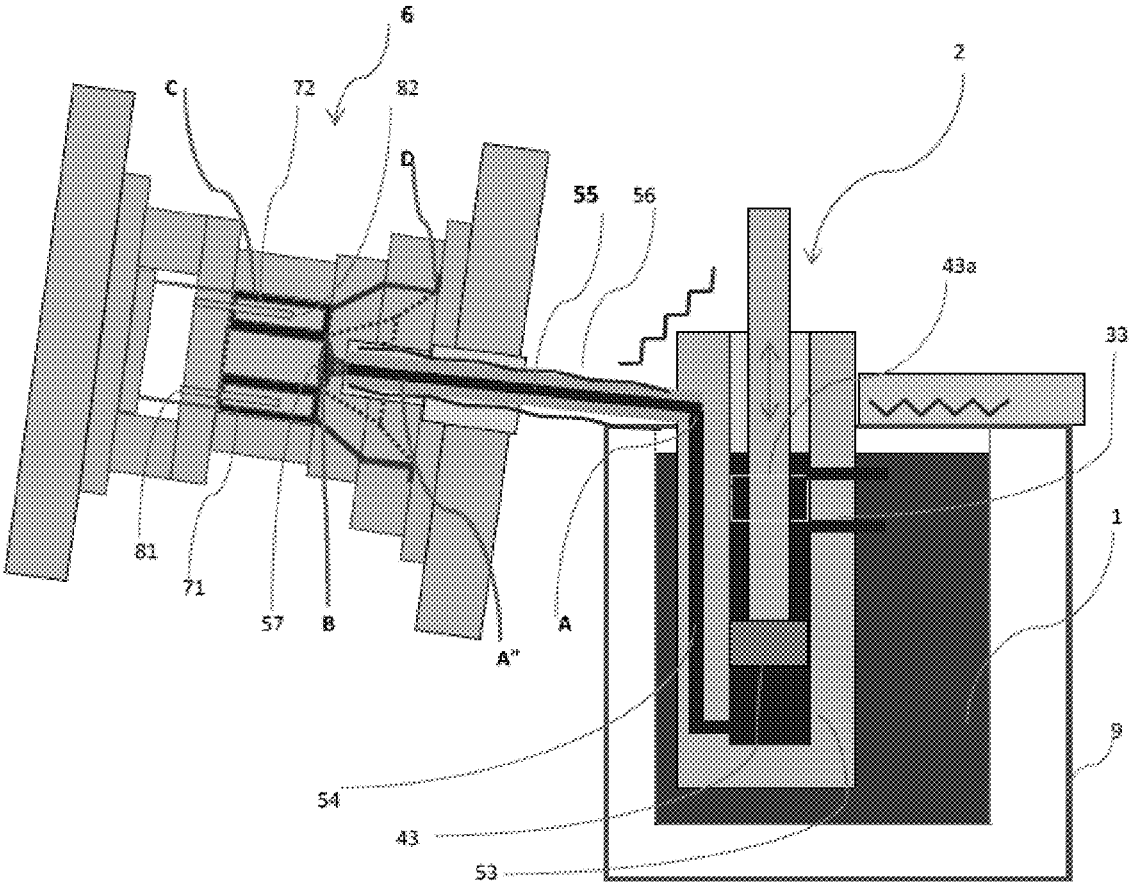

FIG. 3 schematically shows a preferred configuration of the plant for the realization of the proposed LMPDC process: pump 2 is immersed in the molten alloy 1, not overheated but at the melting temperature or slightly different, which enters by gravity into cylinder 53 through mouth 33 when the injector piston 43 is in the retracted position 43*a* (indicated in dashed line). Subsequently, alloy 1 is pushed by piston 43, represented at the end of filling, through duct 54 practically immersed in the molten alloy and through the supply ducts 55 and distribution ducts 57, practically at the same temperature of the alloy, within the envelope of the casting in the closed metal mold 6, which contains the disposable non-metallic cores 71 and 72 supported by supports 81 and 82.

The filling phase of the cavities around the cores 71, 72 occurs at a speed tolerable by the cores themselves, while the following phase for the eventual completion of the casting and its compaction, given the availability of reasonable switching times and of high pressures, can take place at high speed.

The distribution duct 57, perpendicular to the drawing, can be thermally insulated and conditioned with systems known in the art. The supply duct 55, equipped with a heating device 56 controlled and regulated, must possess tensile strength at medium pressures at high temperature, as well as the property of resisting corrosion by the molten alloy and metallization with the same, at least on the surface in contact with the molten alloy. From the experiences of the applicant, as described in IT 1376503, alloys of tungsten and molybdenum are well suited for this purpose, but other known solutions could be adopted such as coatings with some technical ceramics.

The configurations of the casting ducts in the HPDC process can considerably differ from what is shown schematically in FIG. 1, but the ducts cannot be shortened and easily heated as in the plant shown schematically in FIG. 3 given the location of container 51, necessarily located lower than mold 6. Since the steel surfaces of the organs in contact with the molten alloy lose their hardness at about 700° C., the alloy cannot be overheated beyond this temperature whereby the HPDC technology cannot do without premature cooling of the alloy and the resulting short times and therefore high injection speeds, while the LPDC technology cannot take advantage of high pressures over the molten alloy and therefore must give up the compaction of the casting and optimal and complex morphologies thereof.

Figure 5:
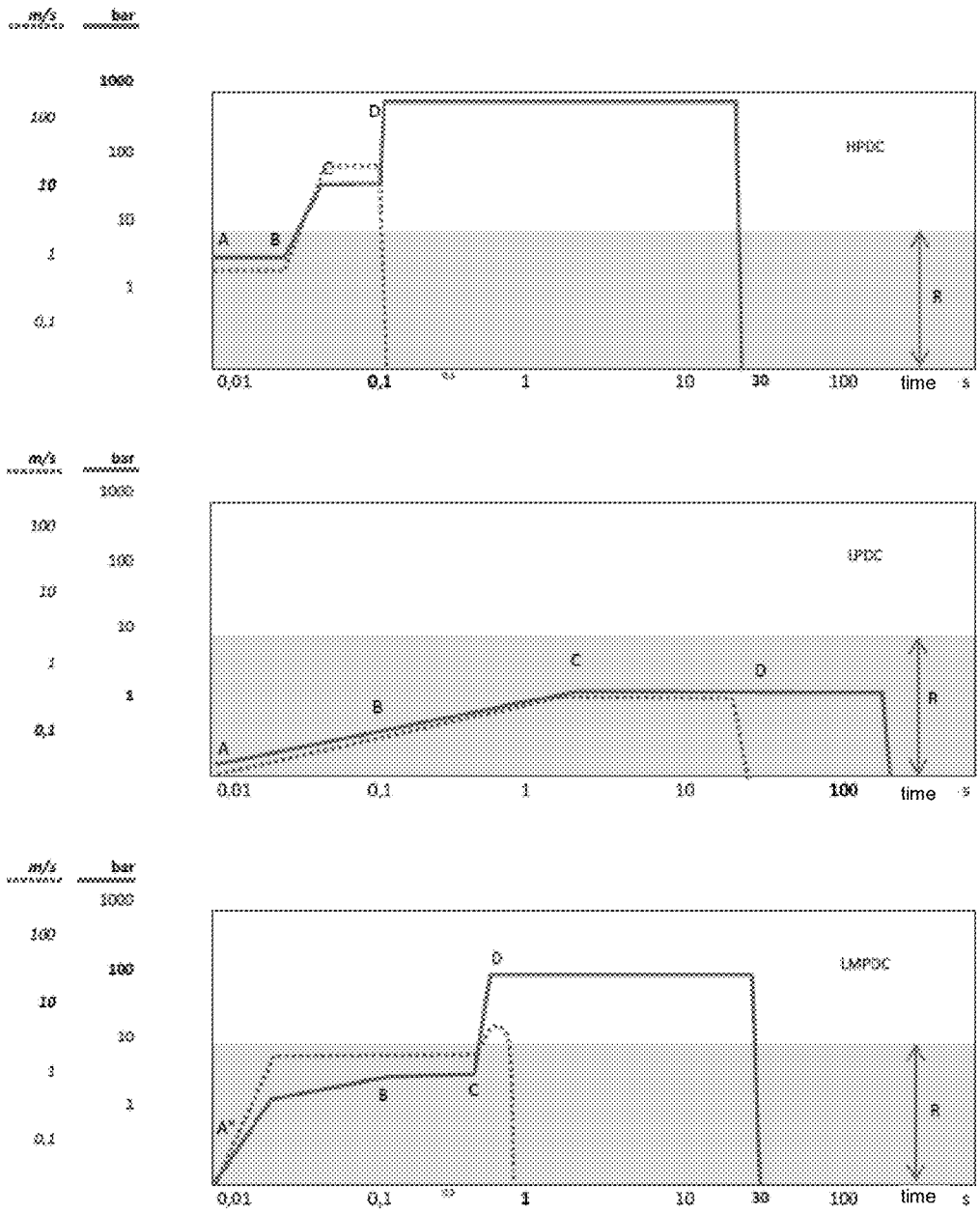

In FIG. 5, by way of example, there is schematically illustrated the time course of the indicative pressure and speed parameters of the alloy in a sectional plane of the casting upon reaching the homologous points A-B-C-D of the mold and during the compaction of the casting, in molds for the same object, during the HPDC and LPDC processes and upon reaching points A"-B-C-D for the LMPDC process. The x-axis shows the time in seconds, the y-axis shows the speed in m/s and pressure in bar, with the axes in logarithmic scales. The horizontal bands R symbolically represent the range of the speed and pressure parameters that generate tolerable dynamic stresses on the core being considered, with the objective of its ease of extraction from the casting.

The point A" of the new LMPDC process, homologous to point A of the current technology, indicates the point of prefilling of the supply duet 55 at a controlled temperature, during the closing of the mold. This operation, whose purpose is to reduce the cycle times and especially the amount of air present in the filling phase, and thus the risks of gas bubbles in the casting, is possible in the proposed configuration but not in HPDC plants for the need to close the cavity of container 51 before pouring the molten alloy, nor is it possible in LPDC plants for the difficulties and uncertainties in the determination of the level of the alloy in pipe 52 in the presence of gaseous propellant.

Since the phase of filling the cavities around the cores, represented by segment B-C of FIG. 5, is within band R in the LPDC and LMPDC processes but largely external to band R in the HPDC process, it constitutes the critical phase for the non-metallic cores. The comparison between the orders of magnitude of the speed and pressure parameters with the admissible band for the non-metallic cores, clearly shows the advantages in quality resulting from the new process.

Contrary to the HPDC process, in which the resistance of the cores must adapt to the high speeds and pressures of the alloy, and to the LPDC process, which has pressure too low to feed thin thicknesses and to compact the casting, the new LMPDC process offers the possibility of optimizing the combination of the morphologies, structures and strength characteristics of the non-metallic cores with those of the casting thanks to the ample possibility of control of the parameters of temperature, speed and pressure of the alloy, also allowed by its switching times.

From the differences between the times of the molding cycles, of the order of a few seconds between HPDC and LMPDC but very high for LPDC, are also evident the economic advantages of the new process, the greater the smaller are the parameters of pressure and speed and the casting masses.

Figure 6:
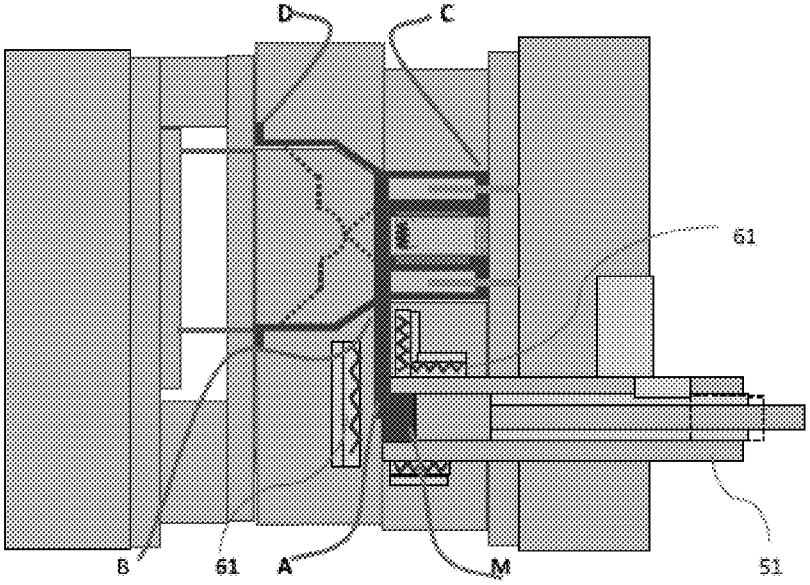

The preferred structure of FIG. 3 can naturally be modified or replaced by others, otherwise configured, in order to implement the new process. For example, the LMPDC process could be implemented, albeit with greater risks and less effectively, by adapting plants of the HPDC type as shown in FIG. 6. It is necessary in this case to sufficiently heat the segments of the A-B duct and the terminal part of container 51 through the insertion of dowels 61 fitted with electric resistors and thermally insulated from the cooled mold.

The phases of the normal HPDC cycle are: slow injection up to point B, rapid injection up to point D, high-pressure compaction, solidification and cooling of the casting and of the sprue M, mold opening with accompanying of the injector piston for the extraction of sprue M, etc.

Figure 7:
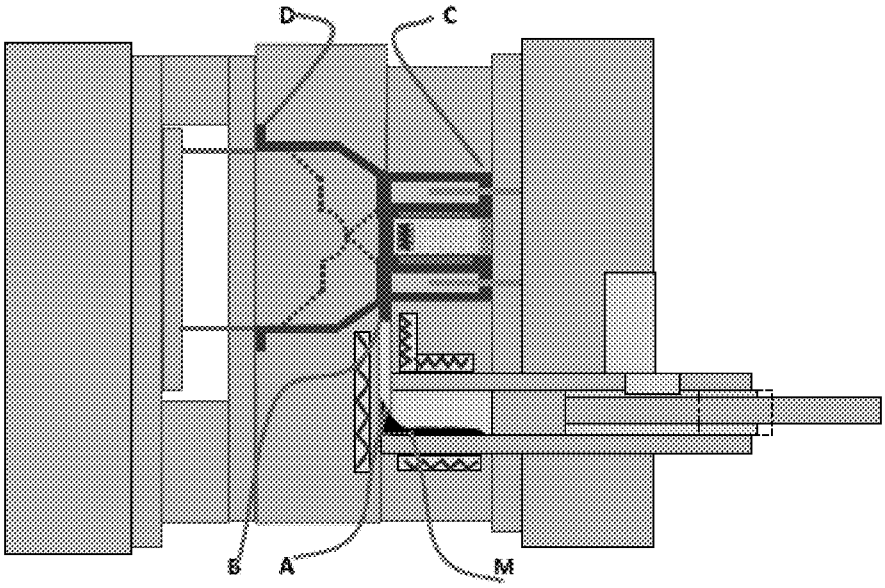

To carry out the LMPDC process with the plant adapted as schematically shown in FIG. 6, the cycle must be substantially modified as follows: slow injection up to point C, rapid injection up to point D, medium-pressure compaction, solidification of the casting, partial return of the injector piston to allow the deflation of sprue M and the emptying of the A-B duct (FIG. 7), cooling of the casting and solidification of the residues of sprue M and supply duct, opening of the mold, removal of the residues (FIG. 8), etc.

Figure 4:
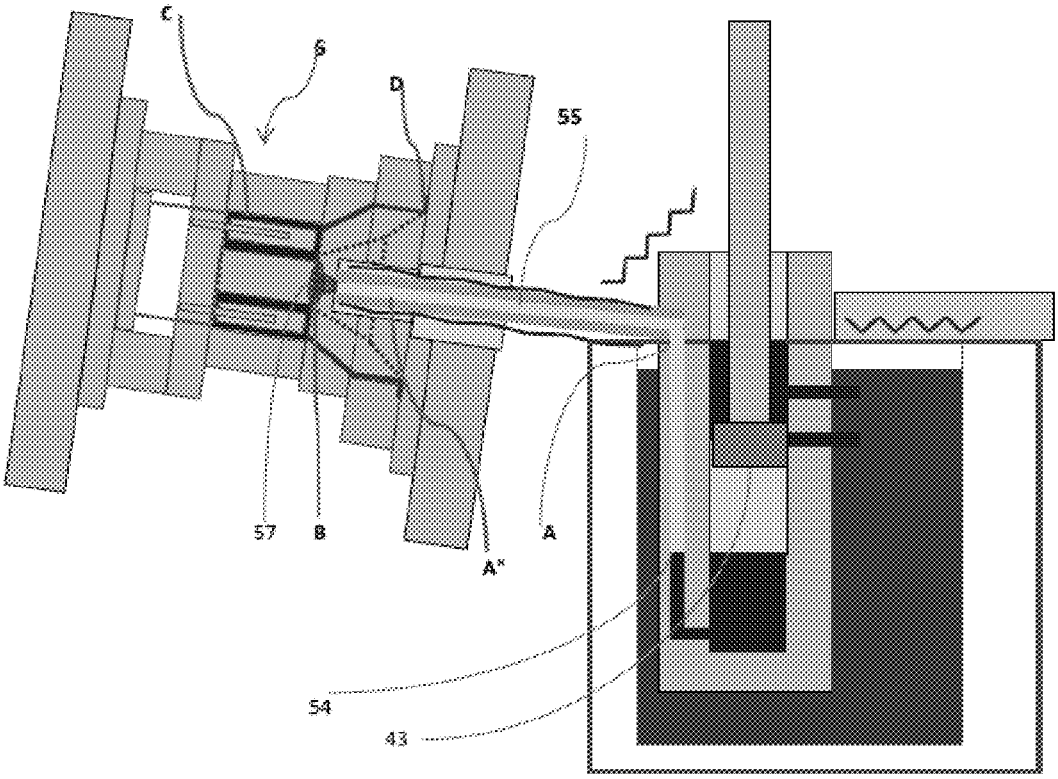
Figure 8:
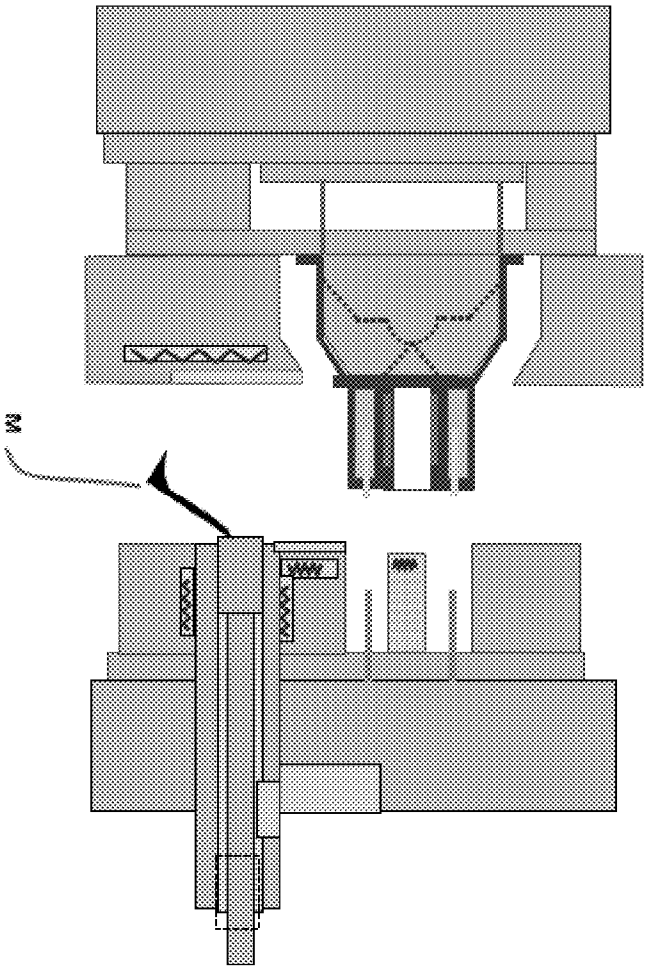

The preference of the hot chamber structure for the plant that implements the LMPDC process also resides in the simplification and reduction of cycle times, since for the recovery of the "residues" recycled in the liquid state immediately after the solidification of the casting (see FIG. 4) the ejection phase illustrated in FIG. 8 is not required, and furthermore recycling in the solid state generates losses of alloy and energy since it concerns material that is oxidized and polluted by the lubricants of the injector piston. One should also be aware of the difficulty of reconciling the heating schematized in FIG. 6 with the absolute necessity to cool the metal molds, using systems that are not represented.

Another solution could be found in HPDC plants with vertical injection, such as that described in U.S. Pat. No. 4,088,178, in which the upper container is realized according to the requirements of the supply duct 55 of the present application, without prejudice to the negative elements mentioned above. However it is clear that HPDC plants would be oversized and economically less suitable for the LMPDC process, compared to the preferred structure.

In the light of the above, it is evident that the proposed process remedies the basic contrasts and limits of the known technologies, high and low pressure, retaining the advantages peculiar to each of the same from the point of view of quality, productivity, proportional costs, such as raw materials and energy, and fixed costs, such as investments in molds, machines and plants.

The invention claimed is:

1. Method for manufacturing light alloy castings by hot chamber injection die casting with disposable cores placed in cavities of a metal mold, comprising a first phase of filling said cavities of said mold around said cores in which parameters of pressure and speed of molten alloy are controlled at levels tolerable by the cores until the cavities around the latter are filled by the molten alloy, and a second phase of filling the mold thereafter, in which said pressure and speed parameters are controlled at levels suitable for completing and compacting the casting, wherein in said first filling phase the parameters of pressure and speed of the molten alloy are respectively controlled at values between 1 to 10 bar and 0.3 to 3 m/s, in said second filling phase the parameters of pressure and speed of the molten alloy are respectively controlled at values between 10 to 300 bar and 3 to 15 m/s, wherein the molten alloy is injected in the mold at a point close to the centroid of the cores, and wherein the alloy is heated substantially along the whole path between a pump that pressurizes it and the entrance to the cavities around the cores so as to keep it at a temperature between its upper melting temperature and a temperature at which the solid fraction content of the molten alloy is not greater than 25% of the liquid fraction content.

2. Method according to claim 1, wherein an injector piston of the pump moves back right after the solidification of the casting and prior to the casting cooling phase, allowing a partial recovery of molten or semi-molten alloy.

3. Method according to claim 1, wherein a portion of a supply duct that leads into the cavities around the cores is filled with molten alloy before completion of the mold closure.

4. Method according to claim 3, wherein in the cavities of the mold and in the volumes directly connected thereto a pressure below atmospheric pressure is established prior to injecting the molten alloy.

5. Method according to claim 1, wherein in the cavities of the mold and in the volumes directly connected thereto a pressure below atmospheric pressure is established prior to injecting the molten alloy.

* * * * *